United States Patent [19]

Sämann

[11] Patent Number: 4,954,385

[45] Date of Patent: Sep. 4, 1990

[54] CARTON PAD

[75] Inventor: Heinz Sämann, Karlsruhe, Fed. Rep. of Germany

[73] Assignee: Haarkosmetik and Parfumerien, Fed. Rep. of Germany

[21] Appl. No.: 259,276

[22] Filed: Oct. 18, 1988

[30] Foreign Application Priority Data

Oct. 19, 1987 [DE] Fed. Rep. of Germany ..... 8714015

[51] Int. Cl.[5] ..... B65D 81/02; B32B 3/10

[52] U.S. Cl. ..... 428/131; 428/132; 428/133; 428/134; 428/136; 428/192; 428/99; 428/121; 428/130; 428/120; 206/521; 206/591; 206/594

[58] Field of Search ..... 428/131, 132, 133, 134, 428/136, 192, 99, 121, 130, 120; 206/521, 591, 594

[56] References Cited

U.S. PATENT DOCUMENTS

| | | | |
|---|---|---|---|
| 2,783,930 | 3/1957 | Riley | 206/521 |
| 2,979,248 | 4/1961 | Washington | 206/594 X |
| 3,333,757 | 8/1967 | Strauss | 206/594 X |
| 3,356,209 | 12/1967 | Pezely, Jr. | 206/594 X |
| 4,388,355 | 6/1983 | Ikemizu | 428/120 X |
| 4,810,544 | 3/1989 | Hickman | 428/124 X |

FOREIGN PATENT DOCUMENTS

| | | | |
|---|---|---|---|
| 2827994 | 1/1980 | Fed. Rep. of Germany | 206/594 |

*Primary Examiner*—Thurman K. Page
*Assistant Examiner*—William P. Watkins, III
*Attorney, Agent, or Firm*—Steinberg & Raskin

[57] ABSTRACT

A carton pad having a bottom portion with dimensions essentially corresponding to a base area of a carton and having several tabs which, on a respective substantially straight side thereof, are joined to the bottom portion and are otherwise free and can bend out of a plane of the bottom. The straight sides of the respective tabs are arranged substantially perpendicular to a direction in which a row of tabs extends, with the row of tabs being divided at a center thereof in the longitudinal direction, into two mutually mirror-symmetrically arranged halves. Furthermore, a gabled roof-shape support of variable gable angle is provided, with one roof edge thereof engaging in a tab from one of the halves of the row of tabs, and the other roof edge thereof engaging in a tab of the other, mirror-symmetrically arranged row of tabs, so that the roof edges are supported upon the substantially straight sides of the tabs that are connected to the bottom portion.

10 Claims, 2 Drawing Sheets

CARTON PAD

BACKGROUND OF THE INVENTION

The present invention relates to a carton pad. The purpose of the pad is to secure a product in packing containers and, at the same time, to fill any free space within the respective packing container.

Products being shipped in cartons or containers often have a form or shape differing from the form or shape of the carton or container, or only partially fill the respective carton or container. In such cases, it is necessary to secure the object or product within the packing container, and to fill up the free space remaining within the carton or container to avoid damaging the product or damaging the packing container or carton itself. Small filler material has often been used for this purpose, such as styrofoam chips or support materials of styrofoam, cardboard, paper, or excelsior (wood shavings).

However, the use of such materials has many disadvantages. In particular, small-sized filler materials involve inconveniences, because the unpacking of the packed contents is cumbersome and laborious, with the filler material constituting voluminous waste.

The use of such supporting materials also has the disadvantage that the materials are not variable and seldom reliably protect the packed objects or contents against slipping and damage.

SUMMARY OF THE INVENTION

It is therefore an object of the present invention to provide for reliable packing and securing of products or contents within packing containers and cartons in a simple and material-conserving manner.

It is also an object of the present invention to provide for easy varying of the packing and securing of products or contents within different sizes of containers or cartons, so that the requisite packing can be adapted to the particular form of the packing container, and to the particular size and bulk of the product or contents to be packed.

It is a further object of the present invention to provide a device for accomplishing the above-noted packing of products or contents within packing containers or cartons, which is easy to manufacture and also very simple to handle.

These and other objects are attained by the present invention which is directed to a carton pad, comprising a base portion having dimensions essentially corresponding to a base area of the carton and comprising several tabs arranged in a row thereon. Each tab is joined to the base portion along a substantially straight side thereof, and is otherwise free and is bendable out of a plane substantially parallel to a surface of the base portion. Each tab is also arranged with the substantially straight side thereof extending substantially perpendicularly to a direction in which the row of tabs extends.

The row of tabs is divided into two separate row sections, with a gabled support of variable gable angle also being provided, and having an edge for engaging a respective tab of one of the row sections, and an opposite edge for engaging a respective tab of the other row section. The respective edges of the support are supported along the straight sides of the respective tabs, when the support is engaged with the base portion.

Preferably, the row of tabs is divided substantially at a midpoint thereof into two substantially mirror-symmetrically arranged row sections of tabs. The surface of the base portion is preferably substantially rectangular, while the base portion may additionally comprise, along two opposite edges thereof, substantially straight fold lines which each define a narrow edge strip along the respective edge which is bendable out of the surface plane of the base portion, and is disposed to brace the base portion against a sidewall of the carton. Preferably, the base portion additionally comprises respective fold lines along four edges thereof (e.g. when the surface of the base portion is substantially rectangular), with these fold lines defining four edge strips. Corners of each edge strip are cut out so that all four of the edge strips can be bent out of the surface plane.

The base portion may additionally comprise at least two fold lines which are spaced from one another, extend substantially parallel to one another, extend substantially perpendicularly to the row direction of the tabs, and are situated between the row sections. The base portion may even comprise two additional fold lines extending between the row sections of the tabs.

Also, the base portion may comprise two substantially parallel rows of tabs. Each tab may be stamped out of the base portion. Furthermore, each tab may comprise a respective grip recess.

More specifically, and with reference to the accompanying drawings to be described in greater detail below, the above-noted problems and difficulties encountered in the prior art are eliminated with a carton pad in accordance with the present invention, which comprises (a) a bottom 1 having dimensions essentially corresponding to a base area of the carton and having several tabs 2 which, on a straight side 3 thereof, are joined to the bottom 1 and are otherwise free and can be bent out of a plane of the bottom or base portion 1. The straight sides 3 of the tabs 2 are arranged substantially perpendicularly to a direction in which the row of tabs 2 extends, while the row of tabs 2 is divided at a center of the longitudinal direction thereof, into two mutually mirror-symmetrically arranged halves.

Furthermore, the carton pad of the present invention also comprises (b) a gabled 14 roof-shaped support 4 of variable gable angle, and having one roof edge 5 for engaging a tab 2 of one of the halves of the row of tabs 2, and another roof edge 6 for engaging a tab 2 of the other, mirror-symmetrically arranged row of tabs 2, so that the two roof edges 5 and 6 are supported on the substantially straight sides 3 of the tabs 2 connected or joined to the bottom 1 or base portion of the pad.

For use, the bottom of the carton pad in accordance with the present invention is placed on the product or contents which are packed within the carton or container, with the gabled roof-shaped support being inserted at one of each of the roof edges thereof into one of the respective tabs on the bottom. Selection of the tabs from the row of tabs along the bottom thereof, depends upon the size of the space to be filled within the carton or container. These two tabs are selected so that the gable of the support braces against the cover of the packing container or carton.

In this manner, the carton pad is pressed by the cover of the container or carton against the product or contents within the container or carton, so that the product or carton contents are secured against slipping. The pad is variable or versatile due to the plurality of tabs at the bottom thereof, so that the pad can be used in different containers or cartons of different sizes, and for products or contents of different volume. If the product fills the container in the direction of height, but does not fill the container in the direction of length of width, then it is possible to alternatively apply the pad so that the roof gabled 14 of the roof-shaped support braces against one of the sidewalls of the container, rather than against the cover of the container.

The form of the bottom of the pad can be selected at will and depends, in general, on the form of the packing container itself. However, the form of the bottom of the pad is preferably rectangular or square.

The tabs of each half of a row of tabs are bent out of the bottom plane in a manner such that a free end of each tab protrudes in the direction of the other half of the row.

Also, the form of the tabs themselves is freely selectable, but generally the tabs will be rectangular, trapeze-shaped, semicircular, or ellipsoidal. However, the straight side of the tab connected to the bottom of the pad must be formed so that the gabled, roof-shaped support finds sufficient hold thereon.

Also, the dimensions of the roof-shaped support depend upon the space to be filled within the packing container. The dimensions of the support are not, to a certain extent, dependent upon the dimensions of the bottom of the pad. In other words, one and the same support can be utilized in conjunction with bottom or base portions of different dimensions.

Preferably, the bottom of the carton pad in accordance with the present invention has a substantially straight fold line on each of at least two opposite sides in the edge regions thereof. This results in a narrow strip, movable about the fold line axis at the edge of the bottom. This strip can be bent out of the plane of the bottom. Firstly, the variability of the carton pad in accordance with the present invention is additionally increased by the provision of such an edge strip, because the pad can be adapted even better to a base area of the packing container itself. Additionally, the edge strips increase friction between walls of the packing container or carton and the bottom or base portion of the pad, thereby ensuring still a better fixation of the products or contents stored therein.

Such an edge strip is preferably provided on all sides of the bottom or base portion, with these edge strips possibly having different widths. To allow these edge strips to be individually movable, corners of the bottom portion of the pad are preferably cut out. Furthermore, these edge strips, especially edge strips on longer sides of the rectangular bottom, may have cut outs in a central region thereof.

According to a further preferred embodiment of the present invention, the bottom of the pad has at least two additional fold lines, arranged substantially parallel to one another and substantially perpendicular to the direction in which the row of tabs extends, and situated between the two halves of the row of tabs. The purpose of these fold lines is to permit the bottom of the carton pad to be adapted to a product of different height. Therefore, the fold lines are clearly spaced from one another, so that different levels can be adjusted. Several more fold lines, e.g. four such fold lines, may be provided to make the bottom of the pad even more adjustable or variable to the extent desired.

According to another preferred embodiment of the present invention, the bottom of the carton pad has two rows of tabs arranged substantially parallel to one another. The use of two rows of tabs gives the new carton pad especially great stability. This is of importance, in particular, for packing containers having a large base area.

In an especially preferred embodiment, the tabs intended to receive the roof edges of the gabled, roof-type support, are stamped out of the bottom itself. Therefore, in using the carton pad, all that is necessary is to bend the desired tab out of the plane of the bottom thereof. For such a form of an embodiment in accordance with the present invention, it is preferred to reinforce the ends of the sides of the tabs connected with the bottom thereof, for example a bottom formed of cardboard, by gluing a film-type material over the corners of the tabs before punching out.

To facilitate the pulling out of the tabs from the plane of the bottom, in particular in the case of punched-out tabs, a grip recess being preferably provided at a free end of the respective tab.

The carton pad in accordance with the present invention may be made of plastic, however it is preferably made from cardboard, in particular corrugated cardboard. Manufacture of the carton pad of the present invention takes place in a simple manner. It suffices to provide two surface areas, one of which serves as a bottom and the other of which serves as a gable-like support. The bottom is provided with the desired fold lines in the usual manner. The tabs can either be glued on or, as noted above, stamped out of the bottom. The planar structure that is to be used as the gabled support, is also provided with a fold line. This fold line runs substantially parallel to two opposite edges of the planer structure, and preferably substantially in the middle of the support. When the surface halves separated by this fold line are bent out of the original plane, a gabled roof-type structure is obtained, the "ridge height" of which is adjustable by the gable angle and the distance between "ridge fold" and "roof edge".

The carton pad in accordance with the present invention therefore constitutes an especially simple device for securing product material in packing containers or a device for filling the free space in packing containers. This carton pad is more environmentally-friendly and more cost-effective than plastic chips which were used until now. In particular, it should be noted that because of the variability or adjustability, the carton pad can be used repeatedly. Additionally, due to its easy handling, i.e. flapping up of the desired tabs from the bottom and inserting of the gabled roof-type support, the carton pad results in a considerable reduction of work in packing as well as unpacking a product contained in the carton.

BRIEF DESCRIPTION OF THE DRAWINGS

The present invention will now be described in greater detail below, with reference to the accompanying drawings, in which.

DESCRIPTION OF THE PREFERRED EMBODIMENTS

Figure 1:
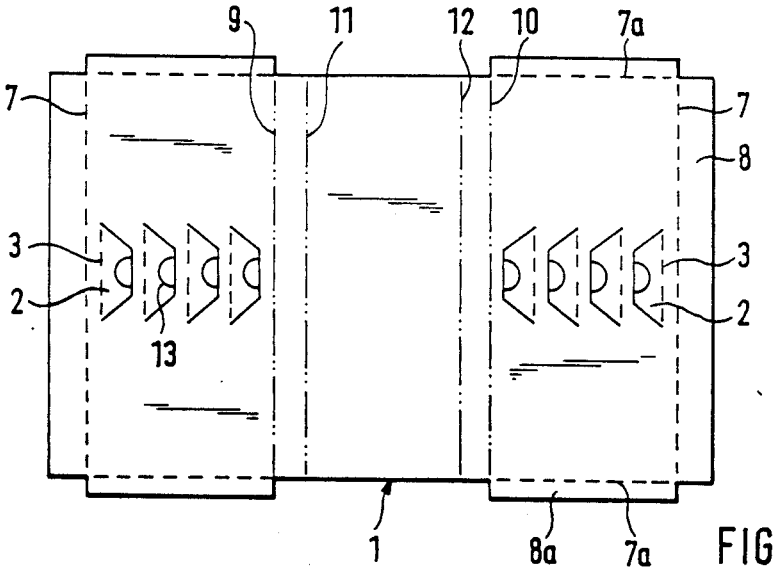
FIG. 1 illustrates a plan view of a bottom of a carton pad in accordance with the present invention.

A bottom 1 of a carton pad in accordance with the present invention has several trapeze-shaped tabs 2 arranged in a row. The tabs 2 are firmly connected to the bottom 1 along respective straight sides 3 thereof, for example along a fold line or a perforation. Otherwise, the tabs 2 are freely movable, thus being pivotable about an axis formed by the respective straight sides 3 thereof, so that the tabs 2 can be bent out of the bottom plane. However, as illustrated in FIG. 1, the tabs 2 are still situated in the bottom plane. To facilitate extraction of the tabs 2 from the bottom plane, the tabs are each provided with a respective grip recess 13.

The row of tabs 2 is divided at a center of a longitudinal direction thereof, into two halves arranged in substantial mirror symmetry to one another. The tabs 2 are arranged so that the free end of each tab 2 points in a direction of a center axis of the bottom 1 of the pad, this center axis being substantially perpendicular to the longitudinal direction of the row of tabs 2. In other words, the free end of each tab 2 is situated closer to the center axis of the bottom 1 of the pad, than the straight side 3 of the respective tab which is firmly connected to the bottom 1 of the pad, as clearly seen in FIG. 1.

The substantially rectangular bottom 1 has, in the edge region of the two shorter sides thereof, a substantially straight fold line or perforation 7. A straight fold line 7*a* has also been provided on each of the two longer sides of the bottom 1 as illustrated. However, as also illustrated in FIG. 1, there is a cutout in the center of the longer sides of the substantially rectangular bottom 1 as seen in FIG. 1, i.e. there is a gap between respective edge strips 8*a*. The fold lines 7 and 7*a* define formation of the narrow edge strips 8 and 8*a* respectively, which are each movable about an axis formed by the respective fold lines 7 and 7*a*.

Firstly, the variability or adjustability of the bottom 1 is increased, and additionally the friction between the bottom 1 and walls of a packing container are also increased by provision of these respective edge strips 8 and 8*a* as noted above, so that the product or content within the container is better secured.

Moreover, the edge strips 8 and 8*a* are cut out at the corners of the bottom 1 as illustrated, so that the edge strips 8 and 8*a* are movable independently from one another.

The narrow edge strips 8 and 8*a* may additionally be provided with several incisions which run substantially parallel to the respective fold lines 7 or 7*a*, to make the bottom 1 even more adaptable.

Figure 3:
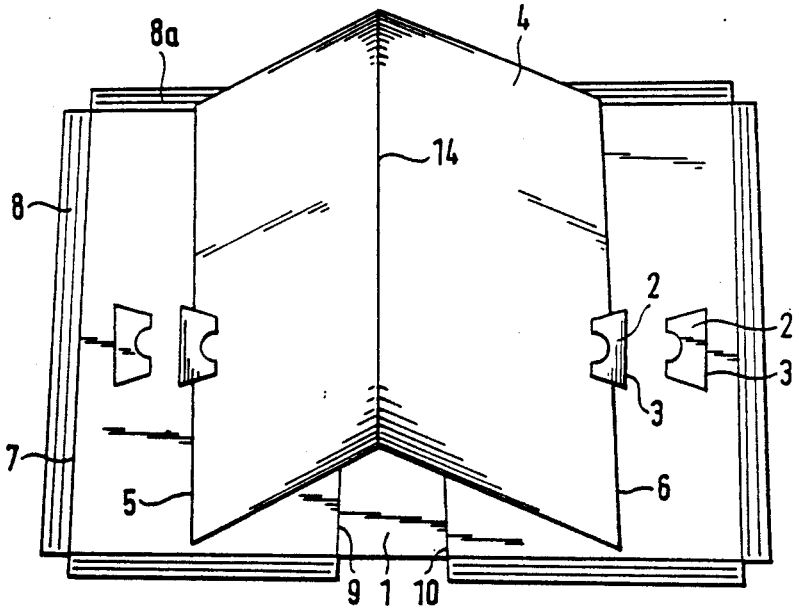
FIG. 3 is a perspective view of one embodiment of the carton pad in accordance with the present invention as it is assembled.
Figure 4:
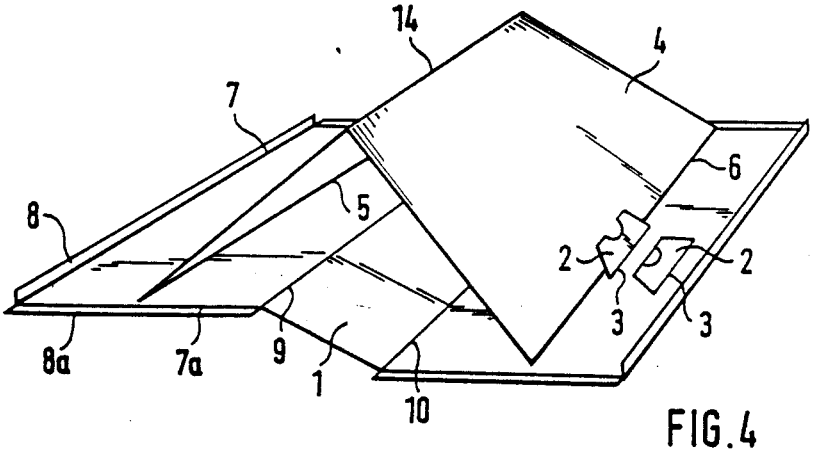
FIG. 4 is a perspective view of another embodiment of a carton pad in accordance with the present invention, as it is also assembled.

Moreover, additional fold lines 9, 10, 11 and 12 have been provided in the bottom 1, as illustrated in FIG. 1. By means of these fold lines, the bottom 1 can be bent at an angle. Thus, product or content of different height can be also securely fixed or secured within the packing container. Due to the number of fold lines, e.g. four as illustrated, the bottom 1 is also variable with respect to different height of product or content that is stored. FIGS. 3 and 4 illustrate two such fold lines 9 and 10.

Figure 2:
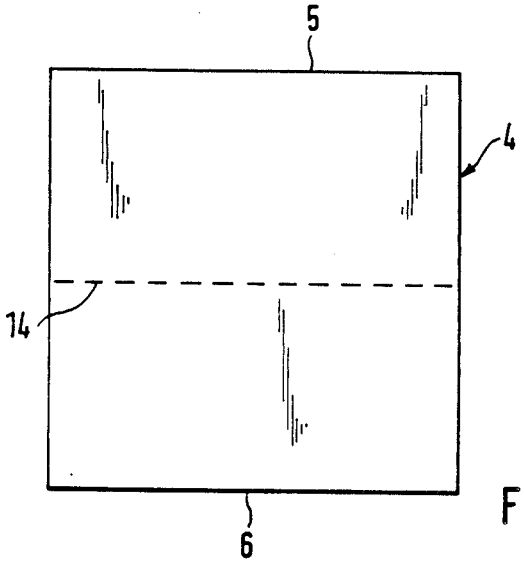
FIG. 2 illustrates a plan view of a gabled, roof-shaped support of a carton pad in accordance with the present invention.

FIG. 2 illustrates a gabled, roof-shaped support 4 with a gable 14 and two lateral roof edges 5 and 6 extending substantially parallel to the gable 14. The support 4 cooperates with the bottom 1, in that first a tab 2 is pulled out in each respective half of the row of tabs 2 from the bottom plane, and the edges 5 and 6 of the support 4 are engaged in the pulled-out tabs 2 in a manner such that the edges 5 and 6 are supported on the straight sides 3 of the tabs 2 connected with the bottom 1, as can be seen, for example, in FIGS. 3 and 4.

FIG. 4 shows, moreover, a carton pad according to the present invention in which the bottom 1 is bent at an angle along the fold lines 9 and 10. As has been noted, the different height of the product to be stored is taken into account by this arrangement.

Use of the carton pad in accordance with the present invention is made, for example, by placing the bottom 1 onto the product being stored, pulling out the desired tab 2 from each half of the row of tabs 2, and inserting the gable-like support 4. However, the support 4 can be inserted outside of the packing container itself, if convenient.

Due to the fact that several tabs 2 are present in each half of the row thereof, and also possibly due to the dimensions of the support 4, it is possible to adjust the height of the carton pad according to the present invention at will, so that the gable 14 of the support 4 can brace against the cover of the packing container, whereby fixation or securing of the product or content is carried out.

For unpacking and removing the carton pad according to the present invention, a single manipulation suffices, namely pulling out of the carton pad itself. If required, the carton pad can then be collapsed by removal of the gable-type support 4 and can be used once again.

The preceding description of the present invention is merely exemplary, and is not intended to limit the scope thereof in any way.

What is claimed is:

1. A carton pad, comprising a base portion having dimensions essentially corresponding to a base area of the carton and comprising several tabs arranged in a row thereon, each said tab being joined to said base portion along a substantially straight side thereof, and being otherwise free and bendable out of a plane substantially parallel to a surface of said base portion, each said tab being arranged with said substantially straight side thereof extending substantially perpendicularly to a direction in which said row of said tabs extends, said row of said tabs being divided into two separate row sections, and a gabled support of variable gable angle, having an edge for engaging a respective tab of one of said row sections and an opposite edge for engaging a respective tab of the other of said row sections, with respective said edges of said support being supported along said straight sides of said respective tabs and engaged with the same.

2. The combination of claim 1, wherein said row of said tabs is divided substantially at a midpoint thereof into said row sections which are two substantially mirror-symmetrically arranged row sections of said tabs.

3. The combination of claim 1, wherein said surface of said base portion is substantially rectangular.

4. The combination of claim 1, wherein said base portion additionally comprises, along two opposite edges thereof, substantially straight fold lines which each define a narrow edge strip along said respective edge which is bendable out of the surface plane of said base portion, and disposed to brace said base portion against a sidewall of the carton.

5. The combination of claim 4, wherein said base portion additionally comprises respective fold lines along four edges thereof and defining four edge strips, with corners of each said edge strip being cut out so that all four of said edge strips can be bent out of said surface plane.

6. The combination of claim 1, wherein said base portion additionally comprises at least two fold lines which are spaced from one another, extend substantially parallel to one another, extend substantially perpendicularly to the row direction of said tabs, and are situated between said row sections.

7. The combination of claim 6, wherein said base portion additionally comprises two additional fold lines extending between said row sections of said tabs.

8. The combination of claim 1, wherein said base portion additionally comprises two substantially parallel rows of tabs.

9. The combination of claim 1, wherein said tabs are stamped out of said base portion.

10. The combination of claim 1, wherein each said tab comprises a grip recess.

* * * * *